United States Patent [19]

Zahedi

[11] Patent Number: 4,918,782

[45] Date of Patent: Apr. 24, 1990

[54] CARPET FASTENER

[76] Inventor: Bijan Zahedi, 1333 Grand Ave., Piedmont, Calif. 94610

[21] Appl. No.: 312,476

[22] Filed: Feb. 21, 1989

[51] Int. Cl.[5] ..... A47G 27/02

[52] U.S. Cl. ..... 16/11; 16/10

[58] Field of Search ..... 16/4, 10, 11, 17

[56] References Cited

U.S. PATENT DOCUMENTS

| | | | |
|---|---|---|---|
| 349,329 | 9/1886 | Willet | 16/10 |
| 507,517 | 10/1893 | Küster | 16/11 |
| 584,612 | 6/1897 | Triesler | 16/10 |
| 617,204 | 1/1899 | Thoma | 16/17 |
| 648,976 | 5/1900 | Mourad | 16/17 |
| 1,489,352 | 4/1924 | Jacobson | 16/17 |

FOREIGN PATENT DOCUMENTS

| | | | |
|---|---|---|---|
| 208932 | 1/1924 | United Kingdom | 16/11 |
| 326923 | 3/1930 | United Kingdom | 16/10 |
| 379024 | 8/1932 | United Kingdom | 16/10 |

*Primary Examiner*—Richard K. Seidel

*Assistant Examiner*—James Miner

*Attorney, Agent, or Firm*—Harris Zimmerman; Howard Cohen

[57] ABSTRACT

A fastener for securing carpet in place on the treads of staircases or elsewhere includes an anchor member having a boss at one end which extends out of the carpet and a relatively thin flat arm which extends under the carpet and which is fastened to the underlying surface by screws or the like. A longer clamping member has a connector end secured to the boss of the anchor member and extends along the anchor member arm above the carpet to a location beyond that of the arm. The undersurface of the clamping member is stepped downward at that location forming a pressure pad which exerts pressure against the carpet beyond the anchor member arm, the pressure pad surface preferably being roughened to resist lateral motion of the carpet. Lugs on one of the members enter slots in the other to prevent pivotal motion of the clamping member relative to the anchor member.

7 Claims, 2 Drawing Sheets

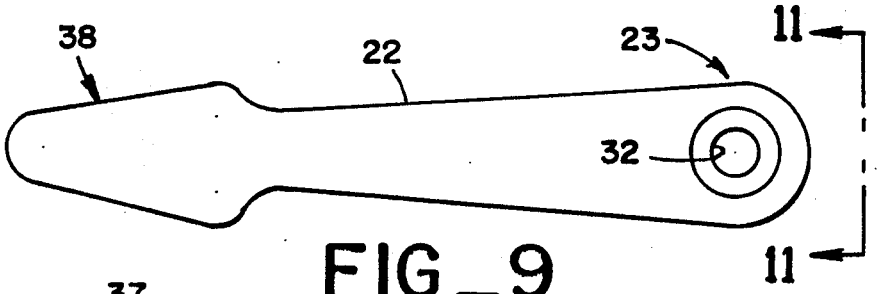
FIG_9
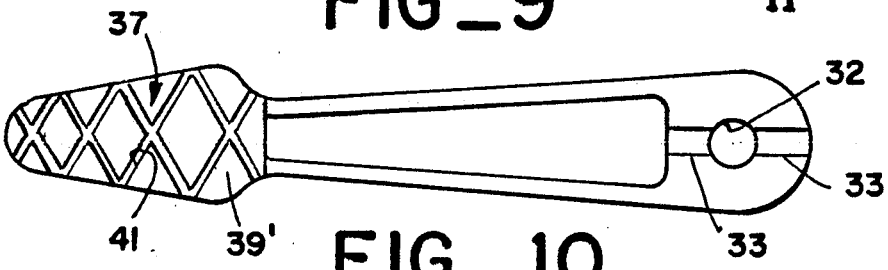
FIG_10
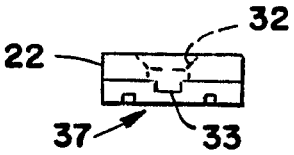
FIG_11
FIG_5
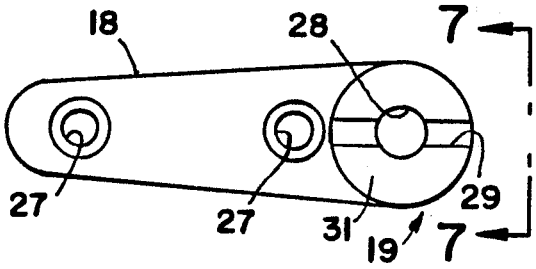
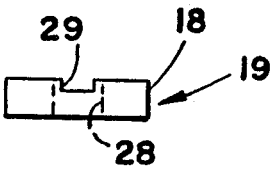
FIG_7
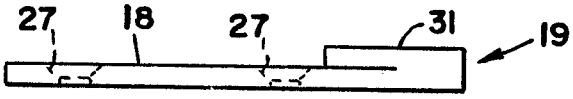
FIG_6
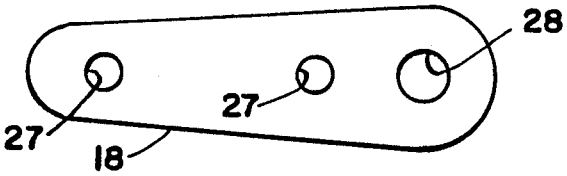
FIG_8

CARPET FASTENER

TECHNICAL FIELD

This invention relates to the fastening of carpet, rugs or the like to an underlying surface and more particularly to devices for holding down and immobilizing a carpet or the like on staircases or other surfaces.

BACKGROUND OF THE INVENTION

Loose carpets, rugs or the like tend to be displaced by activities which occur in the area. This can be an inconvenience and can present a safety hazard under some circumstances. The problem is particularly pronounced where carpeting is installed on a staircase.

Carpet is typically installed on a staircase as a continuous strip of the material which extends up the vertical risers as well as along the horizontal treads. Gravity tends to pull the carpeting down and off of the staircase. Consequently it is generally necessary that the carpeting be securely fastened down. This can also be advisable where carpeting is installed over a horizontal floor in rooms, hallways or the like. Hanging of ornamental display rugs on a wall is subject to a further problem in that penetration of the rug by fastening devices causes damage that can adversely affect the appearance and value of the rug.

Conventional techniques for securing carpeting in place are not entirely satisfactory in several respects. A common practice on staircases involves placing a rod against the carpet at the back of each step to hold the carpet in the configuration of the staircase, the ends of the rod being held in place by brackets, screws or the like. Such rods do not apply much clamping pressure against the carpeting and thus do not immobilize the carpet to the extent that would be desirable.

Carpets are also commonly fastened down with tacks. This does not provide a particularly strong fastening of the carpet to the underlying surface as individual tacks can be rather easily pulled out by activities which occur on the carpet. Tacks also complicate removal of carpeting as the take laden materials requires careful handling.

Use of adhesives for securing carpeting in place also complicates removal and can damage the carpet material.

It would be advantageous if carpeting could be more securely fastened to an underlying surface preferably by unobtrusive means that can be easily installed, which enables easy disengagement and removal of the carpeting and which can be used without penetrating the carpet or rug with components of the fastener in instances where that is desirable.

The present invention is directed to overcoming one or more of the problems discussed above.

SUMMARY OF THE INVENTION

In one aspect, the invention provides a carpet fastener for securing a carpet or the like to an underlying surface which includes an anchor member for disposition against the underlying surface. The anchor member as a boss at one end and a relatively thin flat arm proportioned to extend under an adjacent region of the carpet, the anchor member having screw passages for enabling securing of the anchor member to the underlying surface. The fastener further includes a carpet clamping member for disposition over the anchor member and the adjacent region of the carpet in substantially parallel relationship with the anchor member. The clamping member has a connector end for engagement with the boss of the anchor member and an opposite end with a pressure pad undersurface for exerting clamping pressure against the carpet. The clamping member has a length sufficient to position the pressure pad beyond the location of the arm of the anchor member. The fastener further includes means for releasably securing the connector end of the clamping member to the boss of the anchor member and means for preventing pivotal movement of the clamping member relative to the anchor member.

In another aspect of the invention, a carpet fastener for securing a carpet or the like to an underlying surfaee includes an elongate anchor member for disposition against the underlying surface which has a boss at one end and a relatively thin flat arm extending from the base of the boss for emplacement under the carpet. The arm has a plurality of passages for receiving screws or the like for fastening the anchor member to the underlying surface. An elongated clamping member extends in parallel relationship with the anchor member and has a connector end abutted against the boss of the anchor member and an opposite end for disposition over the carpet to exert downward pressure on the carpet. The clamping member is longer that the anchor member to locate the opposite end of the clamping member beyond the anchor member. The opposite end of the clamping member has a pressure pad undersurface for exerting the clamping pressure against the carpet which undersurface is lower than the undersurface of the portions of the clamping member that extend over the anchor member. Disengagable means secure the connector end of the clamping member to the boss of the anchor member and interlocking means prevent pivotal motion of the clamping member relative to the anchor member.

In still another aspect of the invention, a carpet fastener for securing an edge of a carpet or the like to an underlying surface includes an anchor member disposed on the underlying surface and having a boss at one end which extends out of the the carpet. A relatively thin flat arm extends from the boss and is situated below the carpet, the arm being fastened to the underlying surface beneath the carpet. A clamping member has a connector end secured to the boss of the anchor member and extends over the carpet in parallel relationship with the arm of the anchor member to a location beyond the anchor member. The clamping member has an undersurface which is stepped downward at the location to form a pad which exerts pressure against the carpet at that location.

The invention provides a carpet fastener which more strongly clamps carpeting, rugs or the like to an underlying surface to prevent displacement, lifting or wrinkling of the carpet. The fastener is easily installed and can be easily disassembled to release the carpet for renovation or replacement. The fasteners can be inconspicuously located at the back corners of the treads of a staircase while functioning to hold carpeting in the configuration of the staircase. The fasteners can also be used without necessarily cutting into or penetrating carpets or rugs in situations where that is desirable such as where highly valuable rugs are to be hung on a wall for display.

BRIEF DESCRIPTION OF THE DRAWINGS

FIG. 5 is a top view of an anchor member component of the carpet fastener.

FIG. 6 is a side view of the anchor member.

FIG. 7 is an end view of the anchor member taken along line 7—7 of FIG. 5.

FIG. 8 is a view of the underside of the anchor member.

FIG. 9 is a top view of a carpet clamping member of the carpet fastener.

FIG. 10 is a view of the underside of the carpet clamping member.

FIG. 11 is an end view of the carpet clamping member taken along line 11—11 of FIG. 9.

DETAILED DESCRIPTION OF THE PREFERRED EMBODIMENT

Figure 1:
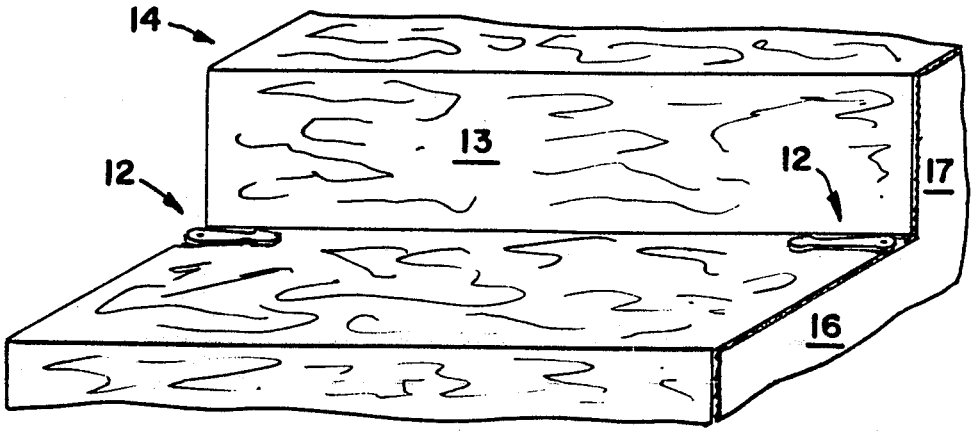
FIG. 1 is a perspective view of a portion of a staircase having carpeting which is clamped to the stair treads by carpet fasteners embodying the invention.

Referring initially to FIG. 1 of the drawings, carpet fasteners 12 embodying the invention are particularly useful for holding carpeting 13 in place on a staircase 14 although the fasteners may also be used to secure carpets and rugs in place at other locations. At a staircase 14, an individual fastener 12 may be situated at each side of each stair tread 16 at the back of the tread adjacent the vertical riser 17 which extends up to the next trend. Preferably the fasteners 12 extend in parallel relationship with the risers 17. The fasteners 12 then act to immobilize the carpeting 13 and to hold it in the configuration of the staircase 14 and do not create any obstacle to foot travel on the staircase 14 as they are confined to the back corners of the treads 16.

Figure 2:
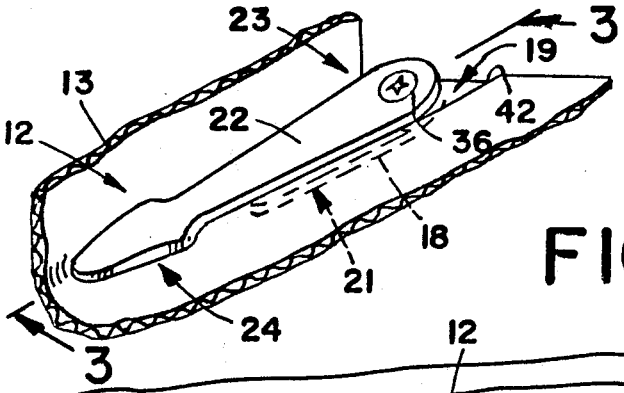
FIG. 2 is a larger scale perspective view of one of the carpet fasteners of FIG. 1.
Figure 3:
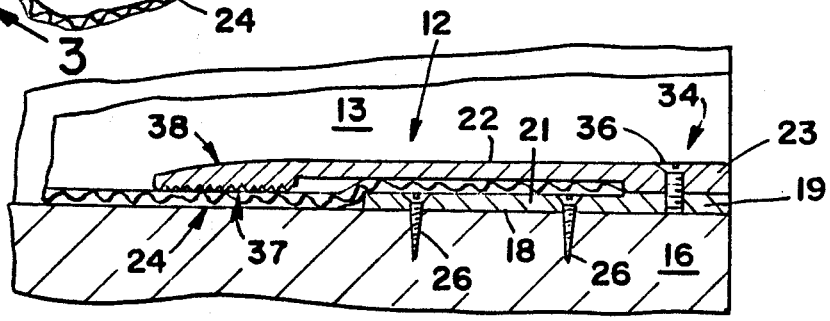
FIG. 3 is an elevation section view of the carpet fastener taken along line 3—3 of FIG. 2.

Referring to FIGS. 2 and 3, the carpet fastener 12 includes an elongate anchor member 18 having a boss 19 at one end and having a relatively thin flat arm 21 which extends from the base of the boss and which is proportioned to extend under a portion of the carpet 13 that is to be secured in place. The fastener 12 also includes an elongate carpet clamping member 22 having a connector end 23 which engages on the boss 19 of the anchor member 18. In use, the clamping member 22 extends over the carpet 13 in parallel relationship with arm 21 of anchor member 18 to a location 24 beyond the end of the arm 21 and exerts clamping pressure against the carpet at that location.

Figure 4:
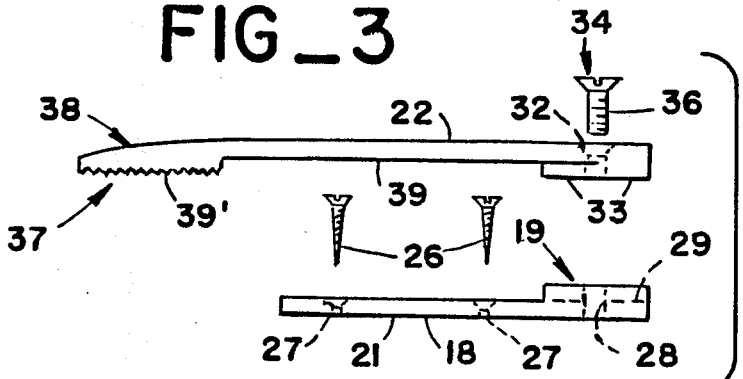
FIG. 4 is an exploded side view of the carpet fastener of FIG. 2 showing the device in disassembled condition.

Referring jointly to FIGS. 3 and 4, the anchor member arm 21 is secured to the underlying surface, stair tread 16 in this example, by a pair of screws 26. As better seen in FIGS. 5 to 8, the anchor member arm 21 has a pair of spaced apart screw passages 27 for this purpose which passages are beveled at the upper ends. Location of the screw passages 27 in the arm 21 portion of the anchor member results in the screws being concealed by the carpet after installation.

The boss 19 portion of anchor member 18, which is circular in this example, has a threaded axial passage 28 and has a diametrical slot 29 in the upper surface 31 of the boss that intersects the upper end of passage 28. Referring to FIGS. 9 to 11, the connector end 23 of clamping member 22 also has a vertical passage 32 which is beveled at the upper end and a pair of lug projections 33 extend down from the lower surface of end 23, the lugs being aligned along opposite radii of the passage 32. Referring again to FIGS. 3 and 4, the lugs 33 are proportioned to enter slot 29 of anchor member boss 19 when the clamping member 22 is engaged on boss 19 of the anchor member. This prevents pivotal motion of the clamping member 22 relative to the anchor member 18 and thereby interlocks the two members into a parallel relationship. Means 34 for securing the clamping member 22 to anchor member 18 further includes another threaded screw 36 which seats in the passage 32 of the clamping member 22 and engages in the threaded passage 28 of the anchor-member boss 19.

The boss 19 of anchor member 18 has a height sufficient to hold the clamping member 22 away from arm 21 a distance which enables a portion of the carpet 13 to be received between the arm and clamping member. The boss 19 can, if desired, be proportioned to provide for a loose fit of the carpet 13 between the arm 21 and clamping member 22 to accommodate to carpets of different thicknesses as clamping pressure is applied to the carpet 13 by a pressure pad 37 formed at the end 38 of the clamping member that is remote from the connector end 23. Pad 37 clamps a region of the carpet 13 directly against the underlying surface 16 at a location beyond the anchor member 21. This assures that the portions of the carpet 13 which extend between pairs of the fasteners 12 are held flat against the underlying surface 16.

To form the pressure pad 37, the undersurface 39 of clamping member 22 is downwardly stepped near end 38 of the member. This locates the pad undersurface 39′, which is preferably flat, closer to the surface 16 which underlies carpet 13 than the undersurface 39 of other portions of clamping member 22 and assures that the pad 37 will exert the desired clamping pressure upon tightening of screw 36.

Referring to FIGS. 10 and 11, the undersurface 39′ of pad 37 is preferably roughened to enable the pad to strongly grip carpet 13 and to resist lateral forces that might tend to slide the carpet. For this purpose, in this example, the undersurface 39′ has a plurality of intersecting grooves 41. Use of such intersecting grooves 41 causes the pad 37 to resist lateral forces on the carpet that may be exerted in different directions.

To further enhance the grip of pad 37 on the carpet 13 while minimizing the bulk and weight of the clamping member 22, the pad is preferably broader than the shank portion of the clamping member 22 which adjoins the pad.

Referring again to FIGS. 1 and 2, notches 42 may be cut into the edges of carpeting 13 at the back corners of each stair tread 16 to receive the bosses 19 of the fasteners 12. It should be noted that the fasteners 12 do not necessarily require any cutting or other penetration of the carpet material in instances where the carpeting does not extend all the way to a vertical wall surface either on staircases or elsewhere. This is also the case where the fasteners 12 are used to hang display rugs against a vertical wall provided that the top of the rug is situated below the level of the room ceiling.

While the invention has been described with respect to a single preferred embodiment for purposes of example, many modifications and variations of the construction are possible and it is not intended to limit the invention except as defined in the following claims.

I claim:

1. A carpet fastener for securing a carpet to an underlying surface, comprising:

an anchor member for disposition against said underlying surface, said anchor member having a boss at one end and a relatively thin flat arm proportioned to extend therefrom under an adjacent region of said carpet, said anchor member having screw passages for enabling securing of said anchor member to said underlying surface and having a threaded passage in said boss, a carpet clamping member for disposition over said anchor member and said adjacent region of said carpet in substantially parallel relationship with said anchor member, said clamping member having a connector end for engagement with said anchor member at said boss thereof and having a passage in said connector end that aligns with said threaded passage of said boss, said clamping member further having an opposite end extending from said connector end with a flat pressure pad undersurface for exerting clamping pressure against said carpet, said clamping member having a length sufficient to position said pressure pad undersurface beyond the location of said arm of said anchor member, said clamping member being downwardly stepped at the junction between said pressure pad and the adjoining portion of said clamping member to locate said pressure pad undersurface at a lower level than said adjoining portion of said clamping member and wherein said pressure pad undersurface of said clamping member has protuberant areas alternating with recessed areas, a threaded screw extending through said passage at said connector end of said clamping member and being engaged in said threaded passage of said anchor member, and means for preventing pivotal movement of said clamping member relative to said anchor member.

2. The carpet fastener of claim 1 wherein said pressure pad undersurface is broader than the said adjoining portion of said clamping member.

3. The carpet fastener of claim 1 wherein said recesses of said pressure pad undersurface are intersecting grooves in said pressure pad undersurface.

4. The carpet fastener of claim 1 wherein said screw passages in said anchor member are situated in said arm thereof whereby said screws or the like which attach said anchor member to said underlying surface are concealed by said carpet.

5. The carpet fastener of claim 1 wherein said means for preventing pivotal movement of said clamping member relative to said anchor member includes at least one projection on one thereof positioned to enter an indentation in the other thereof.

6. The carpet fastener of claim 1 wherein said boss of said anchor member has a top surface having a transverse groove therein which extends radially with respect to said threaded passage, and wherein said connector end of said clamping member has a bottom surface shaped for fitting against said top surface of said anchor member at said boss thereof, and wherein said means for preventing pivotal movement of said clamping member relative to said anchor member includes a lug projection on said bottom surface proportioned to enter said transverse groove when said clamping member and said anchor member are oriented in parallel relationship.

7. In a carpet installation which includes an area of carpet or the like and at least one carpet fastener securing said carpet or the like to an underlying surface, the combination comprising:

an anchor member disposed on said underlying surface and having a boss at one end which extends out of said carpet and a relatively thin flat arm which extends from said boss and which is situated below said carpet, said arm being fastened to said underlying surface beneath said carpet, and wherein said boss has a threaded passage therein, a clamping member having a connector end abutted against said boss of said anchor member and which extends over said carpet in parallel relationship with said arm of said anchor member and in spaced apart relationship therewith to a location beyond that of said anchor member, said clamping member having an undersurface which is stepped downward at said location to form a pad for exerting pressure against said carpet at said location, and wherein said clamping member has a passage at said connector end that is aligned with said threaded passage of said anchor member a threaded screw extending through said passage of said clamping member and being engaged in said threaded passage of said anchor member to secure said members together and being tightened sufficiently to cause said clamping member to exert pressure against said carpet, and interlocking means for preventing pivotal motion of said clamping member relative to said anchor member.

* * * * *